United States Patent [19]

Di Blasio

[11] Patent Number: 4,615,518

[45] Date of Patent: Oct. 7, 1986

[54] DOCUMENT HANDLING AND COUNTING APPARATUS

[75] Inventor: John Di Blasio, Medford, N.J.

[73] Assignee: Brandt, Incorporated, Bensalem, Pa.

[21] Appl. No.: 449,665

[22] Filed: Dec. 14, 1982

[51] Int. Cl.[4] ..... B65H 3/06

[52] U.S. Cl. ..... 271/10; 271/121; 271/118; 271/270

[58] Field of Search ..... 271/4, 6, 7, 10, 11, 271/12, 16, 17, 23, 34, 35, 37, 38, 69, 116, 121, 124, 125, 202, 203, 270, 272, 273, 274, 118

[56] References Cited

U.S. PATENT DOCUMENTS

| | | | |
|---|---|---|---|
| 3,674,258 | 7/1972 | Maier et al. | 271/202 |
| 3,771,783 | 11/1973 | McInerny | 271/122 |
| 3,857,559 | 12/1974 | McInerny | 271/122 |
| 3,944,209 | 3/1976 | Fallos | 271/121 |
| 3,944,210 | 3/1976 | McInerny | 271/35 |
| 3,984,095 | 10/1976 | Zimmer | 271/35 |
| 3,986,712 | 10/1976 | Hasegawa | 271/124 |
| 4,114,870 | 9/1978 | Di Blasio | 271/124 |
| 4,128,236 | 12/1978 | Lundblad | 271/10 |
| 4,373,712 | 2/1983 | Mitzel | 271/272 |
| 4,474,365 | 10/1984 | Di Blasio | 271/124 |

FOREIGN PATENT DOCUMENTS

| | | | |
|---|---|---|---|
| 0151542 | 9/1982 | Japan | 271/10 |

*Primary Examiner*—Bruce H. Stoner, Jr.
*Assistant Examiner*—James E. Barlow
*Attorney, Agent, or Firm*—Louis Weinstein

[57] ABSTRACT

A stack of sheets arranged in an input stacker pass through a nip formed by cooperating feed rollers and stripper assemblies, which serve to separate sheets and feed them one at a time toward an acceleration assembly comprised of acceleration roller and cooperating idler means to form a gap between adjacent sheets for counting the sheets. The accelerated sheets are then fed into an output stacker. Belts couple drive from the accelerating drive rollers to accelerating driven rollers rotatable about an axis coaxial with the feed rollers and also cooperate with stationary guides to cause the sheets to experience some acceleration prior to reaching the acceleration nips. Resilient members cooperate with the feed roller to halt a sheet, in the event of an abrupt halt during normal operation to prevent the sheet from advancing to the acceleration nip. The use of closed loop belts as part of the acceleration apparatus enables the handling and counting sheets in a broader range of sheet length, while avoiding the need for increasing the size of the feed rollers.

14 Claims, 6 Drawing Figures

DOCUMENT HANDLING AND COUNTING APPARATUS

FIELD OF THE INVENTION

The present invention relates to sheet handling and counting apparatus and, more specifically, to novel sheet handling and counting apparatus in which the acceleration means provided to facilitate sheet counting utilizes elongated closed loop belt means to permit the handling and counting of sheets whose lengths extend over a relatively broad range to provide some pre-acceleration and to avoid the need for increase in the size of the feed rollers, to avoid damage to sheets and to provide quieter operation.

BACKGROUND OF THE INVENTION

Mechanization of document handling and counting activities is a field which has developed to a vary considerable degree. Apparatus is presently available to handle count and stack sheets, such as paper currency, checks, food stamps, and the like, at relatively high speeds. One typical apparatus is described in U.S. Pat. No. 3,771,783. This mechanized apparatus typically utilizes cooperating feed and stripper means forming a nip through which sheets pass, the feed and stripper means cooperating to assure the feeding of sheets in single-file fashion toward an out feed location. Acceleration means positioned a spaced distance downstream of the cooperating feed and stripper means provides an acceleration nip through which sheets pass. The purpose of abruptly accelerating sheets is to form gaps between adjacent sheets, which gaps are useful for counting the sheets.

The arrangement shown in aforesaid U.S. Pat. No. 3,771,783, issued Nov. 13, 1973, in which the acceleration nip is separated from the feed and stripper nip, but with no positive drive means being provided therebetween, creates the disadvantage that curled or damaged sheets may undergo additional curling or creasing in this "free-fall" region, lead to the development of the document handling and counting apparatus described in Application Ser. No. 288,646, filed in the U.S. Patent Office on July 30, 1981, and assigned to the assignee of the present invention, now U.S. Pat. No. 4,474,365, which discloses feed rollers mounted on a common axis with an acceleration idler, cooperating with an acceleration roller, forming an acceleration nip with the acceleration idler to abruptly accelerate sheets as they pass through the acceleration nip, whereby sheets moving between the nip formed by the feed roller and stripper assemblies and the acceleration nip are always positively driven by the feed rollers moving toward the acceleration nip to prevent the type of damage which might occur in the apparatus described in U.S. Pat. No. 3,771,783 from occuring through the use of apparatus described in application Ser. No. 288,646, now U.S. Pat. No. 4,474,365, issued Oct. 2, 1984.

The present invention is an improvement upon the apparatus of Application Ser. No. 288,646, now U.S. Pat. No. 4,474,365, issued Oct. 2, 1984, in which sheets having lengths varying over a significantly larger dimensional range are accommodated without the necessity for increasing the size of the feed roller, and in which positive drive is provided for sheets moving between the nip formed by the feed rollers and stripper assemblies and the acceleration nips formed between the acceleration roller and acceleration idler, said positive drive imparting some pre-acceleration to sheets prior to their arrival at the acceleration nips.

BRIEF DESCRIPTION OF THE INVENTION

The present invention is characterized by comprising a plurality of feed rollers and acceleration driven rollers mounted for rotating about a common axis, the acceleration driven rollers being free-wheelingly mounted to permit their rotation independently and at a rotating speed different from that of the feed rollers. Stripper assemblies each cooperate with an associated feed roller to form a feed/stripper nip through which sheets pass for the purpose of assuring that those sheets passing beyond said feed/stripper nip are fed in single-file fashion.

Acceleration drive rollers are mounted upon a common axis arranged in spaced parallel fashion with said first common axis and impart drive to the aforementioned free-wheelingly mounted acceleration drive rollers through resilient, closed loop O-ring belts.

Resiliently mounted acceleration idlers cooperate with each of the aforesaid acceleration drive rollers forming acceleration nips which cooperate to grasp a sheet fed thereto, acceleration of the sheet providing separation between adjacent sheets for counting purposes, as well as for rapidly directing accelerated sheets toward an output stacker for collection thereof.

A stationary guide cooperates with the feed rollers and O-rings extending toward the aforesaid feed/stripper nips and the acceleration nips and cooperate with the feed rollers and O-ring belts to guide sheets toward the acceleration nips. The sheets experience some engagement with the O-ring belts, and have some acceleration imparted thereto before entering the acceleration nips to reduce the abruptness of the acceleration action upon sheets occurring in the kind described in co-pending U.S. Application Ser. No. 288,646, now U.S. Pat. No. 4,474,365, issued on Oct. 2, 1984, thereby significantly reducing the abrupt acceleration imparted to sheets, which significantly reduces the noise generated by the apparatus and further reduces the possibility of imparting damage to sheets being handled and counted.

OBJECTS OF THE INVENTION AND BRIEF DESCRIPTION OF FIGURES

It is, therefore, one object of the present invention to provide a novel sheet handling and counting apparatus in which sheets moving between the feed/stripper nip formed by cooperating feeding and stripping apparatus toward an acceleration nip experiences positive drive through action of either one of said feed means or said acceleration means, or both, as the sheet moves through the said intermediate region.

Still another object of the present invention is to provide a novel apparatus for handling and counting sheets and comprising closed loop acceleration belts extending from the region of said feed means to a position downstream of said feed means, where said belts cooperate with acceleration idlers, whereby said belts provide partly some pre-acceleration to sheets prior to entering said acceleration nip.

The above, as well as other objects of the present invention, will become apparent when reading the accompanying description drawing in which.

Figure 5A:
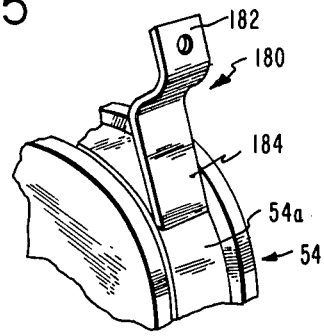
Figure 2:
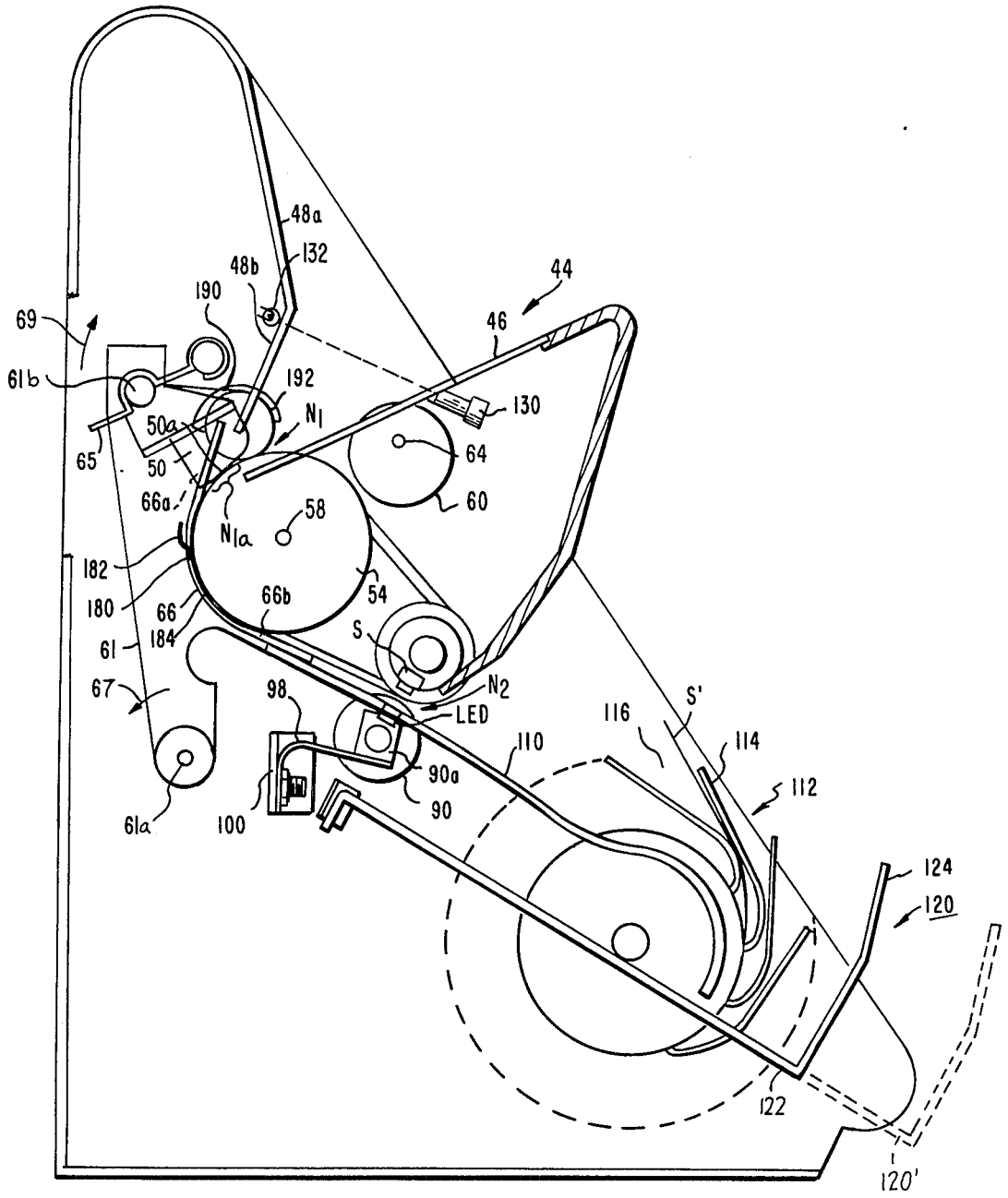
FIG. 2 shows an elevational view of the handling and counting apparatus of FIG. 1.

FIG. 5*a* is a perspective view showing a portion of one of the feed rollers and a leaf spring as shown in FIG. 2.

DETAILED DESCRIPTION OF THE INVENTION

Figure 1:
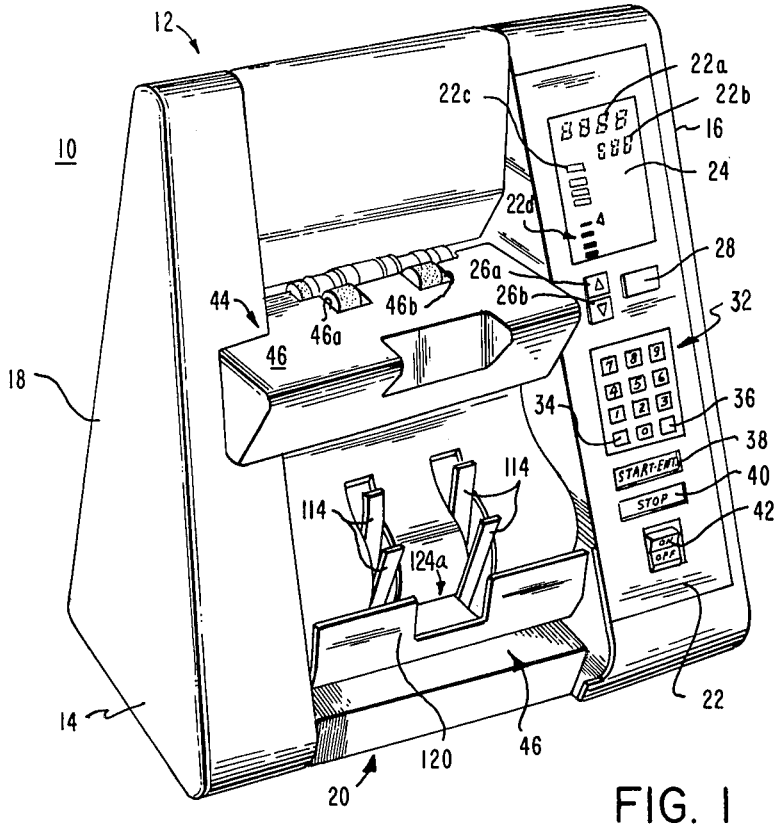
FIG. 1 is a respective view showing a sheet handling and counting apparatus embodying the principles of the present invention.
Figure 5:
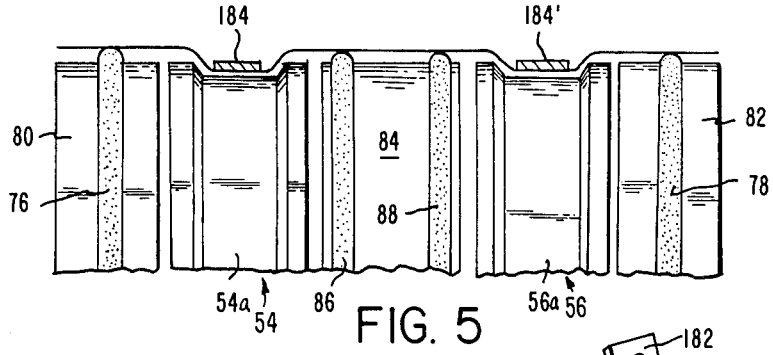
FIG. 5 shows an elevational view, partially sectionalized of the feed and driven rollers of FIG. 3.

FIG. 1 shows a sheet handling and counting apparatus 10 embodying the principles of the present invention and comprising a housing 12 of the apparatus and between generally triangular-shaped side walls 14 and 16, rear wall 18 and inclined front surface 20. The front end of apparatus 10 is provided with a control panel 22, having a display 24 and control pushbuttons 26*a*, 26*b*, button 28, decimal key set 32 for the decimal digits "0" through "9", further including suspect document button 34, batch button 36 and also includes start/enter button 38, stop button 40 and on/off switch 42.

The control panel display 24 is of the liquid crystal type, in which a cummulative count of the total number of sheets counted is displayed at 22*a*, the size of a batch is displayed at 22*a* (in the event that a batching operation is being performed); display portion 22*c* indicates the type of error which has occurred, causing the apparatus to halt the operation; a density display at portion 22*d* indicates the density or thickness of sheets being counted. The density adjustment, i.e., greater or smaller density, is respectively made by the density adjustment buttons 26*a* and 26*b*.

Decimal key set 32 permits the operator to select the size of the batch to be accumulated when performing batching operations. Button 36 is depressed to place the apparatus 10 in the batching mode. In the event that it is desired to perform a test to detect the presence of "suspect" (i.e., counterfeit) bills, button 34 is depressed.

The start-enter button 38 permits a manual start of the apparatus 10. Stop button 40, when depressed, halts operation of the apparatus 10, regardless of the operating mode.

The front end 20 of the apparatus 10 is further provided with an in-feed and input stacker portion 44 for receiving a stack of sheets to be counted. The sheets move through the apparatus and, after being handled and counted, are neatly stacked in output stacker 120.

The mechanism utilized for handling, counting and stacking sheets will now be explained in more detail in conjunction with FIGS. 1–3. Noting especially FIG. 2, the input stacker 44 is comprised of an inclined supporting surface 46, which supports the stack of sheets. Rear supporting surface 48 provided at the lower end of surface 48*a* engages the leading edges of a stack of sheets and serves to "fan" the stack of sheets to facilitate the feeding operation. The leading edges of the bottommost group of sheets move toward a nip $N_1$, defined by a pair of stripper assemblies 50, 52 which cooperate with a pair of feed rollers 54, 56 (note also FIG. 3), upon a common shaft 58. The feed rollers 54 and 56 each have a central recess 54*a*-56*a* into which the stripper members 50, 52 at least partially extend, as shown best in FIG. 3. The curvature of each stripper member the number 50 as represented by the curved portion 50*a* shown in FIG. 2, cooperates with its associated feed roller 54, 56 to define a tapering "throat", which serves as a means to guide each sheet into the feed/stripper nip $N_1$, formed between each stripper member 50 and 52 and its associated feed roller 54, 56 to define an elongated nip region $N_1$a, defined by the conforming curvatures of the stripper members 50, 52 and their cooperating feed rollers 54 and 56.

Sheets placed upon support 46 are initially driven toward nip $N_1$ by means of a pair of eccentric jogging rollers 60, 62 mounted upon common shaft 64. The jogging rollers regularly and periodically extend upwardly through slots 46*a* and 46*b* in support plate 46 to "jog" the stack of sheets and to feed the bottom sheet in the stack toward the nip $N_1$.

The stripper members 50, 52 are mounted upon arm 61, which is swingably mounted upon shaft 61*a* within apparatus 10. Arm 61 is provided with a pin 61*b*, which is releasably secured to a locking spring 65, swingably mounted within the housing of apparatus 10 for selectively locking arm 61 in position. When arm 61 is unlocked, it may be swung counterclockwise, as shown by arrow 67, to facilitate maintenace and inspection of the apparatus.

Figure 3:
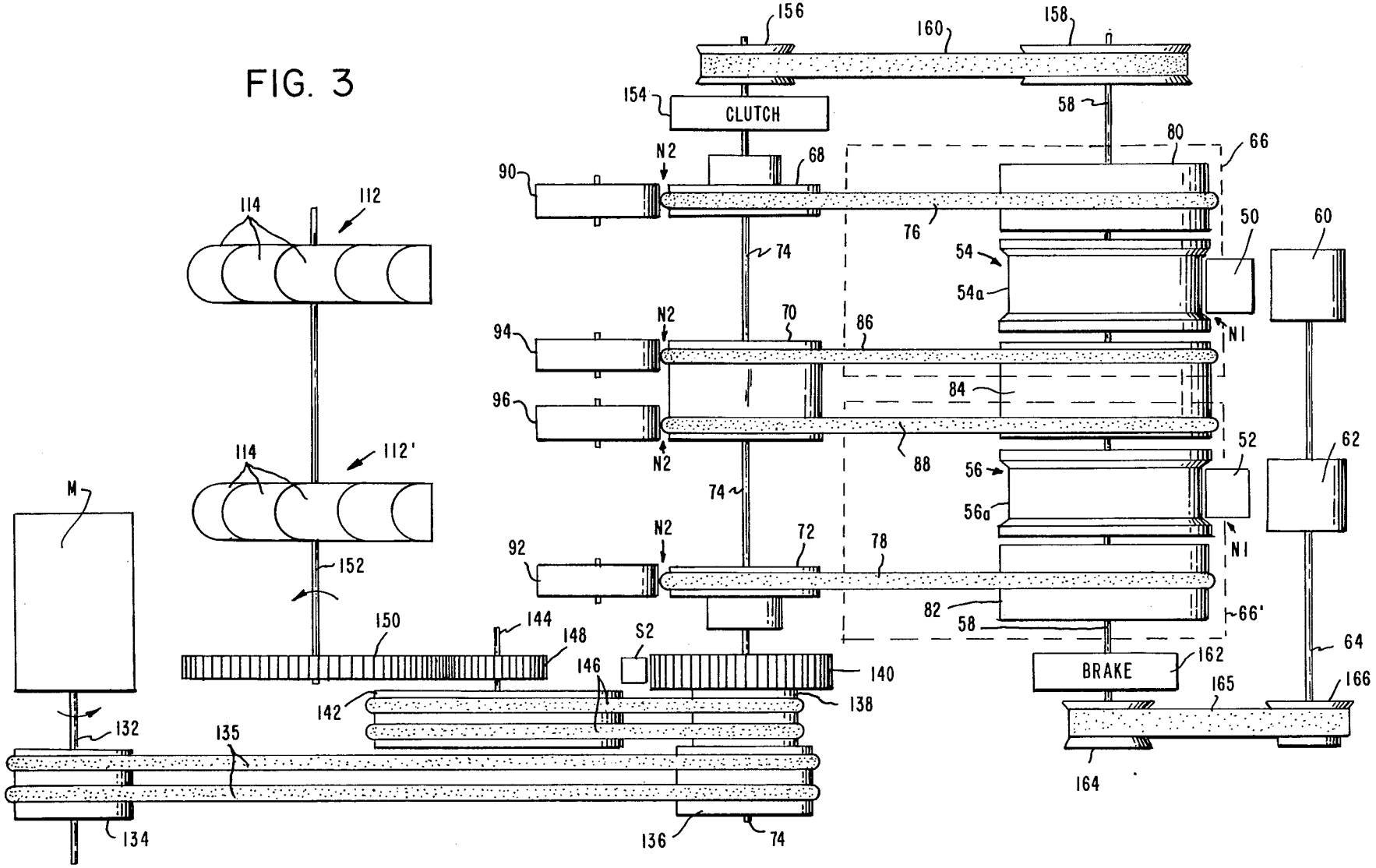
FIG. 3 shows a simplified view of the power train of the apparatus of FIGS. 1 and 2.

Each arm 61 supporting a stripper member 50, 52, further cooperatively supports a curved elongated guide plate 66, 66' (see also FIG. 3), having an upper portion 66*a* positioned between said stripper members 50 and 52 and curving abut the rear-ward portion of the feed wheels 54 and 56, and having a relatively straight portion 66*b* extending beneath the feed wheels and toward three acceleration drive rollers 68, 70 and 72 (see FIG. 3). The acceleration drive rollers 68, 70 and 72 are mounted for rotation upon common shaft 74, as will be more fully described. Acceleration rollers 68 and 72 are each provided with a single closed loop O-ring 76 and 78, respectively entrained about acceleration drive rollers 68 and 72 and further entrained about driven acceleration rollers 80 and 82. Acceleration drive roller 70 cooperates with a third acceleration driven roller 84 to drive driven roller 84 through a pair of O-rings 86, 88 entrained about rollers 70 and 84, respectively, shown best in FIG. 3.

Acceleration driven rollers 80, 82 and 84 are mounted for rotation about common shaft 58 and are free-wheelingly mounted upon shaft 58, so as to rotate independently of shaft 58 and feed rollers 54 and 56 and, in addition to being independently rotatable, are further capable of rotating at a faster rpm than feed rollers 54 and 56.

Each of the acceleration drive rollers, 68, 70 and 72, cooperate with acceleration idlers 90–96, rollers 68 and 72 cooperating with idlers 90 and 92, and roller 70 cooperating with idler rollers 94 and 96, as shown best in FIG. 3. Each of the acceleration idlers is resiliently mounted by means of an L-shaped leaf spring 98, secured at one end to a mounting bracket 100 and secured at the opposite end to a mounting assembly, such as, for example, the mounting assembly 90*a*, for acceleration idler 90. Each of the idlers 90–96 rollingly engages in associated O-ring 76, 78, 86 and 88, respectively, as shown best in FIG. 3. Each of these cooperating idlers and O-rings define an acceleration nip $N_2$ through which a sheet passes as it moves toward the outfeed location, to be more fully described.

The acceleration nips $N_2$ cause sheets entering said nips to be abruptly accelerated, forming a gap between the accelerated sheet and the next sheet to enter the acceleration nips $N_2$, which gap is useful for counting purposes, as is well-known. For example, a light-emitting device LED and a sensor S are positioned in the region of said acceleration nips $N_2$, and on opposites sides of the path along which sheets move. As a sheet moves between source LED and sensor S, the amount of light reaching the sensor is diminished. As soon as the gap moves across this region, the light intensity abruptly increases and remains high until the leading edge of the next sheet moves between the light source LED and the sensor S. This difference in light intensity is utilized for counting purposes, as is well-known.

Accelerated sheets are thereafter advanced along guide plate 110 where they enter into the gap 116 between a pair of adjacent flexible resilient fingers (114) of the stacker wheel assemblies (112, 112'). The leading edge of a sheet, such as for example, sheet S', shown in FIG. 2, strikes the surface of a plate 118, which serves as a stripping plate for stripping sheet S' from the stacker wheels 112, 112', and depositing sheet S' within an output stacker 120, comprising a base plate 122 and an upright end plate 124, having a cut-away center region 124*a* to facilitate gripping of a stack of sheets collected in the output stacker. To accommodate a growing stack of sheets, the output stacker 120 is slidably mounted and urged by a suitable biasing spring (not shown) toward the stacker wheel assemblies 112, 112'. As a stack of sheets is accumulated in the output stacker 120, the output stacker 120 is movable against the aforementioned biasing force, and may ultimately occupy the dotted line position 120'. Once a stack of sheets is lifted out of the output stacker 120, the output stacker will return to the solid line position 120.

FIG. 3 shows the drive train for the apparatus 10 of FIGS. 1 and 2, and comprises motor M having a pulley 134 mounted on its output shaft 132. A driven pulley 136 mounted upon shaft 74 is driven by pulley 134 through a pair of O-rings 138. Thus, whenever motor M is on, pulley 136' shafts 74 and hence, pulleys 68, 70 and 72 are rotating.

A pulley 138 and timing gear 140 are also mounted upon shaft 74. Timing gear 140 cooperates with sensor $S_2$ for timing purposes.

A pulley 142 mounted upon shaft 144 is driven by pulley 138 through a pair of O-rings 146. The gear 148 is also mounted upon shaft 144 and meshes with gear 150 mounted upon shaft 152. Stacker wheel assemblies 112 and 112' are mounted for rotation upon common shaft 152.

An electromagnetic clutch assembly 154 is mounted upon shaft 74 and selectively couples rotational drive to pulley 156. Pulley 156 drives pulley 158, mounted upon shaft 58, through timing belt 160.

An electromagnetic brake 162 is mounted at the opposite end of shaft 58, together with pulley 164, which drives pulley 166 mounted upon shaft 64 through timing belt 168.

The operation of the drive train is as follows:

As long as motor M is turned on, pulleys 68, 70 and 72 and stacker wheel assemblies 112 and 112' are constantly being rotated. During normal sheet handling and counting, clutch 154 is engaged to couple drive through shaft 74 to pulley 156, providing for the rotation of feed wheels 54 and 56. At this time, electromagnetic brake 162 is off, enabling the rotation of shaft 58 and further permitting rotation of the eccentric jogging wheels 60 and 62.

It should be kept in mind that free-wheeling acceleration rollers 80, 82 and 84 do not rotate, due to the rotation of shaft 58, but rotate under control of the acceleration drive rollers 68, 72 and 70, respectively, being coupled thereto through O-rings 76, 78 and 86–88, respectively.

When it is desired to abruptly halt document handling and counting, clutch 154 is operated to disengage pulley 156 from shaft 74.

Substantially simultaneously therewith, electromagnetic brake 162 is activated causing rotation of feed wheels 54 and 56, and jogging wheels 60 and 62 to be abruptly halted. Rotation of the acceleration drive rollers, 68 70 and 72, and driven rollers 80, 82 and 84, as well as acceleration idlers 90–96 and stacker wheel assemblies 112 and 112' continue, to ensure that any sheet which entered the acceleration nips $N_2$ prior to abrupt halting of the feed rollers, will be fed through the acceleration nips $N_2$, and the stacker wheel assemblies 112, 112' to be delivered to the output stacker assembly 120.

Operation of the apparatus of FIGS. 1–3 is as follows:

By placing on/off switch 42 in the on position, the equipment is turned on. However, the motor M is not turned on until at least one sheet is placed in the input stacker 44. The input stacker 44 is provided with sensing means comprising a light source 132 and sensor 130, which senses the presence of at least one sheet to cause the motor M to be automatically turned on. In addition thereto, electromagnetic clutch 154 is operated to couple power from shaft 74 to pulley 156. Brake 162 is turned off at this time, to permit feed rollers 54 and 56 and jogging rollers 60 and 62 to be rotated.

The jogging rollers 60, 62, in addition to jogging or loosening the stack of sheets, moves the bottom sheet toward the feeding and stripping nip $N_1$. The nature of the relative co-efficients of friction of feed wheels 54 and 56 and stripper shoes 50 and 52 are such that the dominant influence of the sheet passing therebetween is exerted on the sheet by the feed wheels 54 and 56, causing the sheet to be fed into the forward feed direction and through a curved path defined by feed wheels 54 and 56 and guide plates 66, 66' and toward the acceleration drive rollers 68, 70 and 72.

As is well known, in the event that two or more sheets move into the feed/stripper nip $N_1$, the bottom sheet will be fed in the forward feed direction, while the remaining sheet or sheets will be restrained from moving in the forward feed direction by the stripper members 50, 52, thereby assuring the feeding of single sheets in the forward feed direction.

As a leading edge of a sheet passes beyond the stripper members 50, 52, it is guided about the feed rollers 54, 56 and acceleration driven rollers 80, 82 and 84, by means of the aforementioned pair of curved guide plates 66, 66', each being secured to one of the swingable arms 62. Although the guideway defined by the O-rings 76, 78, 86 and 88 and the curved guide plates 66, 66' is greater than the thickness of a single sheet, the sheet will nevertheless experience some engagement with one or more of the O-rings 76, 78, 86 and 88, which are moving at a linear speed controlled by the acceleration drive rollers 68, 70 and 72, causing a gradual increase in the velocity of the sheet as it moves through the guideway toward the acceleration nip $N_2$.

Depending upon the lenght of the sheets being run, the trailing portion of a sheet may still be passing through the feeding/stripping nips $N_1$ as its leading edge enters into the acceleration nips $N_2$. Under these circumstances, some slippage occurs between the acceleration O-rings 76, 78, 86, 88 and the associated pinch rolles 90, 92, 94 and 96, due to the resilient mounting of the rollers 90–96, in order to prevent sheets from being damaged or torn.

As soon as the trailing portion of the sheet moves free of the feeding/stripping nip $N_1$, the sheet will then be abruptly accelerated to move at a linear velocity substantially equal to that of the acceleration O-rings 76, 78, 86 and 88.

Sheets reaching the aforementioned increase in velocity are directed toward the stacker wheel assemblies 112, 112', which engage the last sheet delivered to the output stacker 120 to aid in the neat and compact stacking of sheets within the output stacker 120.

As the trailing edge of each accelerated sheet passes beyond the position of the light source LED and the light sensor S, the light-reaching sensor S abruptly increases to provide a signal utilized for counting purposes.

In order to prevent sheets whose leading edges have yet to reach the acceleration nips $N_2$ from being erroneously driven into the output stacker 120, resilient leaf springs, such as, for example, leaf spring 180, are provided. The leaf spring 180 has its mounting portion 182 secured to plate 66 and has its free end portion 184 extending at least partially into the recess 54*a* of feed roller 54, in a manner similar to the stripper members 50, 52, shown in FIG. 3.

Assuming that rotation of the feed 54, 56 or jogging rollers 60, 62 is abruptly halted in the manner previously described by operation of electromagnetic clutch 154 and electromagnetic brake 162, before the leading edge of a sheet reaches the acceleration nips $N_2$, the abrupt rotation of the feed rollers 54, 56 acts in cooperation with the leaf springs 180 as a braking means, to abruptly halt movement of the sheet passing therebetween, so that this sheet will not reach the acceleration nips and thereby be erroneously delivered to the output stacker 120, thereby developing an incorrect count.

In order to facilitate the feeding of light fluffy sheets and/or sheets having a permanent curl or curvature, the apparatus 10, as shown in FIG. 2, is further provided with a swingably mounted roller assembly 190, comprised of a roller 192 which is positioned immediately above the centrally located acceleration roller 84. Light, fluffy sheets engage roller 190, which lightly urges the leading edge of such a sheet toward the O-rings 86, 88 imparting some forward feeding to the sheet just prior to its entry into the stripping/feeding nip $N_1$, as can clearly been seen from a consideration of FIG. 2. The loose, swingable mounting of roller assembly 190 permits the assembly to be driven upwardly by stiffer sheets, since the only biasing force imparted to the roller is the force of gravity.

In order to be assured that the sheets are handled and fed properly, sheets measured in the forward feed direction must have a dimension which is at least as great as the distance between the acceleration nips $N_2$ and the position where the leaf springs 180 grip the trailing portion of the sheet. In one practical embodiment, this dimension is of the order of 2.0 inches. Since the apparatus 10 of the present invention is quite frequently used for purposes of handling and counting paper currency, this lower limit dimension presents no problem, since U.S. currency has a dimension of the order of 2.5 inches in the feed direction, the standard dimension of U.S. currency being width-2.5 inches and length - 6 inches. Sheets of up to four inches measured in the feed direction can be accommodated with the apparatus as shown without changing any of the existing equipment.

Figure 4:
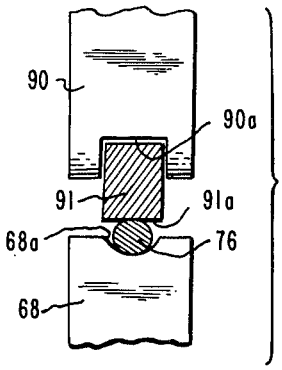
FIG. 4 shows a detailed view of a stripper/feed wheel arrangement.

FIG. 4 shows a detailed view of one of the acceleration drive rollers 68 and its cooperating pinch roller 90. Roller 68 is provided with a semi-circular groove 68*a* for receiving O-rings 76, groove 68*a* having a radius of curvature greater than the radius of O-ring 76. Pinch roller 90 is provided with a substantially square-shaped recess 90*a* for receiving a plastic and, preferably, urethane tire 91, whose exposed surface 91*a* engages O-ring 76. The recess 68*a* is provided with a larger radius of curvature to provide proper seating of O-ring 76 and to accommodate the irregularities in the O-ring during the feeding operation to provide more uniform feeding.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus including feed means for separating sheets delivered to said feed means and advancing sheets one at a time at spaced intervals to facilitate accurate counting of said sheets comprising:

an infeed path along which sheets are advanced toward said feed means, said feed means comprising:

at least one feed roller for rotation about first axis;

at least one upper acceleration roller free-wheelingly mounted to rotate about said common axis and being spaced from said feed roller;

a stripper member arranged to form a first nip with said feed roller and cooperating with said feed roller to advance sheets one at a time in a forward feed direction along said infeed path;

at least one lower acceleration roller mounted to rotate about a second axis parallel to and spaced from said first axis;

at least one O-ring entrained about said upper and lower acceleration rollers;

at least one rotatable cooperating roller mounted adjacent to said lower acceleration roller and rollingly engaging said O-ring to form a second nip for accelerating a sheet as it passes through the second-nip and beyond said feed nip for advancing sheets toward an outfeed location; and curved guide means having a smooth continuous surface extending between said first nip and said second nip and cooperating with said O-ring for defining a guideway for movement of said sheets therealong so that said sheets are not urged into a curved shape transverse to the direction of movement of the sheets but remain substantially flat as they pass through said first nip towards the second nip.

2. The apparatus of claim 1, further comprising resilient spring means associated with said feed roller for engaging a sheet passing therebetween to prevent a sheet which has passed out of said first nip and has yet to enter into said second nip from being advanced thereto in the event of an abrupt halt of said feed roller and while said lower acceleration is still rotating.

3. The apparatus of claim 2, wherein said feed roller is provided with a shallow annular recess;

the free end of each of said resilient spring means extending at least partially into said annular recess.

4. The apparatus of claim 1, wherein said feed roller is provided with a shallow annular recess;

said stripper member extending at least partially into an associated recess.

5. The apparatus of claim 1, wherein said feed guide means comprises a guide plate having a first curved portion encircling a portion of said feed roller and a second substantially straight portion extending away from said feed roller and towards said second nip and substantially parallel to said O-ring.

6. The apparatus of claim 1 further comprising swingably mounted roller means arranged above said upper acceleration roller and cooperating with said one upper acceleration roller to form a third nip, arranged upstream of said first nip, to facilitate the feeding of light, fluffy or curled sheets into said first nip.

7. The apparatus of claim 1, wherein said resiliently mounted cooperating roller includes resilient means sufficiently yieldable to enable a sheet passing through said second nip to experience some slippage, at least until the trailing portion of the sheet passes beyond said first nip.

8. The apparatus of claim 1, wherein said upper acceleration roller is rotated by said lower acceleration roller though said O-ring at an angular velocity, whch is greater than the angular velocity of said feed roller.

9. Apparatus for handling and counting sheets comprising:

input means for receiving a stack of sheets;

feed roller means each rotatable about a first axis;

stripper means each forming a first nip with said feed roller means for advancing only single sheets from the bottom of said stack past said first nip;

upper acceleration roller means coaxial with said first axis;

lower acceleration roller means rotatable about a second axis displaced from and parallel with said first axis;

closed loop belt means for coupling drive between said lower acceleration roller means and said upper acceleration roller means and arranged to engage the adjacent surface of a sheet as it moves between said upper acceleration roller means and said lower acceleration roller means;

cooperating roller means, having an annular periphery rollingly engaging said closed loop belt means adjacent said lower acceleration roller means and forming a second nip spaced from said first nip for accelerating each sheet as its leading edge enters said second nip;

guide means positioned adjacent said belt means and having a smooth, flat continuous surface extendihng across said feed and upper acceleration roller means and forming a guideway with said belt means for guiding sheets between said first and second nips and enabling the sheets to advance along said guideway wihout being urged into a curved configuration in a direction transverse to the direction of movement of the sheets;

the angular speed of said rotatable upper acceleration roller means being greater than the angular speed of said feed roller means.

10. The apparatus of claim 9 further comprising:

means for selectively halting said feed roller means while said upper and lower acceleration roller means and hence cooperating roller means are rotating to drive said closed loop belt means to prevent sheets which have entered said first nip from entering said second nip.

11. The apparatus of claim 10 further comprising:

drive means;

means coupling said drive means to one of said upper and lower acceleration rollers for rotating said upper and lower acceleration rollers;

selective coupling means coupled between said feed roller and said drive means for coupling said feed roller to said drive means in a first operating state and for decoupling said feed roller from said drive means and abruptly halting said feed roller when in a secnd operating state whereby sheets which have entered said first nip are prevented from reaching said second nip and hence said outfeed location.

12. The apparatus of claim 11, wherein said selective means further comprises clutch means for selectively coupling drive to said feed roller.

13. The apparatus of claim 12, further comprising brake means for selectively braking said feed roller.

14. The apparatus of claim 11, further comprising:

an input stacker;

rotatable jogging means for jogging the stack of sheets placed in said input stacker and for feeding the bottom sheet towards said first nip, said jogging means being driven by said selective coupling means.

* * * * *

UNITED STATES PATENT OFFICE

CERTIFICATE OF CORRECTION

Patent No. 4,615,518 Dated October 7, 1986

Inventor(s) Di Blasio, John

It is certified that error appears in the above-identified patent and that said Letters Patent are hereby corrected as shown below:

Column 8, line 32, after "about" insert -- a --.

Column 8, line 34, delete "common".

Column 8, line 66, after "acceleration" insert -- roller --.

Column 9, line 28, change "whch" to --which--.

Column 10, line 6, change "extendihng" to -- extending - -.

Column 10, line 34, change "secnd" to -- second --.

Signed and Sealed this

Sixth Day of January, 1987

*Attest:*

DONALD J. QUIGG

*Attesting Officer*

*Commissioner of Patents and Trademarks*